United States Patent [19]

Ohneda et al.

[11] Patent Number: 5,060,500

[45] Date of Patent: Oct. 29, 1991

[54] APPARATUS FOR AUTOMATICALLY FORMING A POINTED END OF RAW PIPE TO BE DRAWN

[75] Inventors: Noboru Ohneda, Tochigi; Shunta Ushioda, Ibaraki; Haruo Arima, Tochigi; Ichiro Hashimoto; Denziro Kaneko, both of Tochigi; Kazuo Sugiyama, Ibaraki; Tsuguo Fukazawa, Tochigi; Teruo Tachi; Takashi Mukasa, both of Ibaraki, all of Japan

[73] Assignee: Showa Aluminum Kabushiki Kaisha, Osaka, Japan

[21] Appl. No.: 603,126

[22] Filed: Oct. 25, 1990

[30] Foreign Application Priority Data

Oct. 31, 1989 [JP] Japan ..... 1-285952

[51] Int. Cl.[5] ..... B21B 1/16; B21D 41/04; B21D 43/20

[52] U.S. Cl. ..... 72/287; 72/76; 72/408; 72/420; 72/424

[58] Field of Search ..... 72/278, 287, 291, 422, 72/420, 424, 367, 408, 76

[56] References Cited

U.S. PATENT DOCUMENTS

| | | | |
|---|---|---|---|
| 2,519,837 | 8/1950 | Lampard | 72/420 |
| 2,560,058 | 7/1951 | Wrightson | 72/422 |
| 3,209,578 | 10/1965 | Muller | 72/422 |
| 3,399,559 | 9/1968 | Mitchel | 72/367 |

FOREIGN PATENT DOCUMENTS

| | | | |
|---|---|---|---|
| 1147508 | 3/1985 | U.S.S.R. | 72/420 |
| 1078472 | 8/1967 | United Kingdom | 72/422 |

*Primary Examiner*—Daniel C. Crane

[57] ABSTRACT

Apparatus for automatically forming pointed ends for raw metal pipes such as aluminum pipes subject to a drawing process, the pointed end of the pipes being of a reduced diameter convenient for the drawing process. A transporting device moves each raw pipe, which is in alignment with an axis of a pipe inlet of a swaging machine for producing the pointed ends, to a position below the inlet. Each pipe is raised by a lifting device to a height of the pipe inlet so as to be chucked by a gripping device which moves forward to insert a leading end of the pipe into the inlet. The lifting device and the raw pipe are kept out of contact with each other while the leading end is being processed to form the pointed end at the inserted end in the swaging machine whereby efficiency and productivity are improved for the process.

5 Claims, 4 Drawing Sheets

Fig. 1
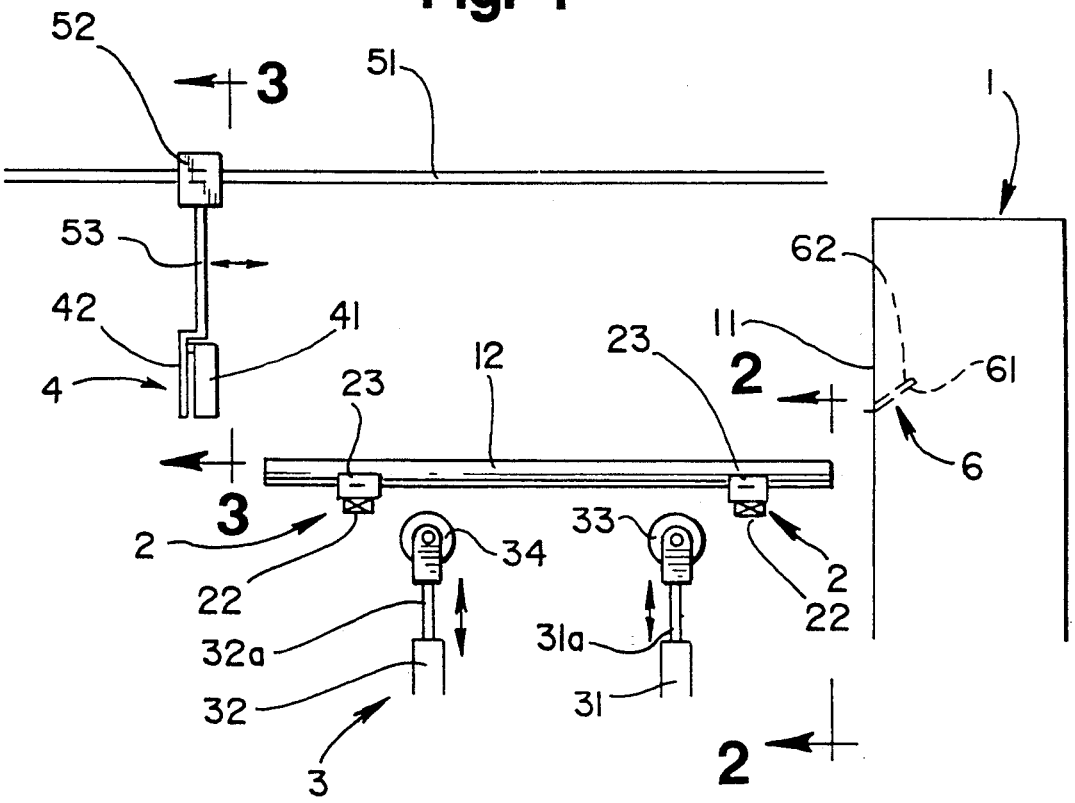
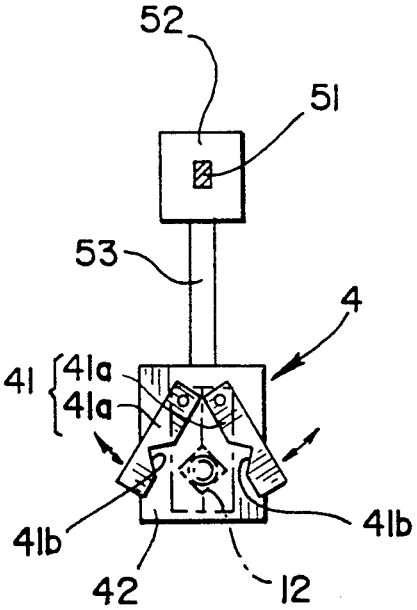
Fig. 3
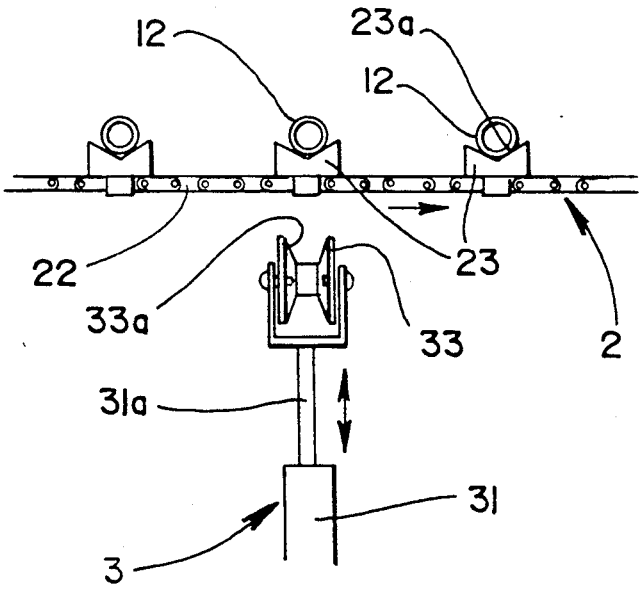
Fig. 2

Fig. 4
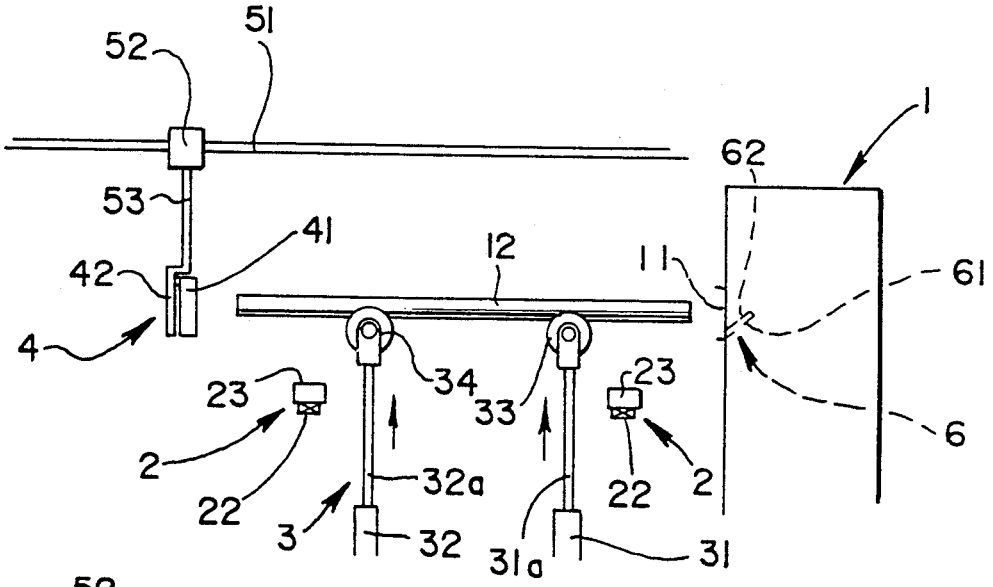
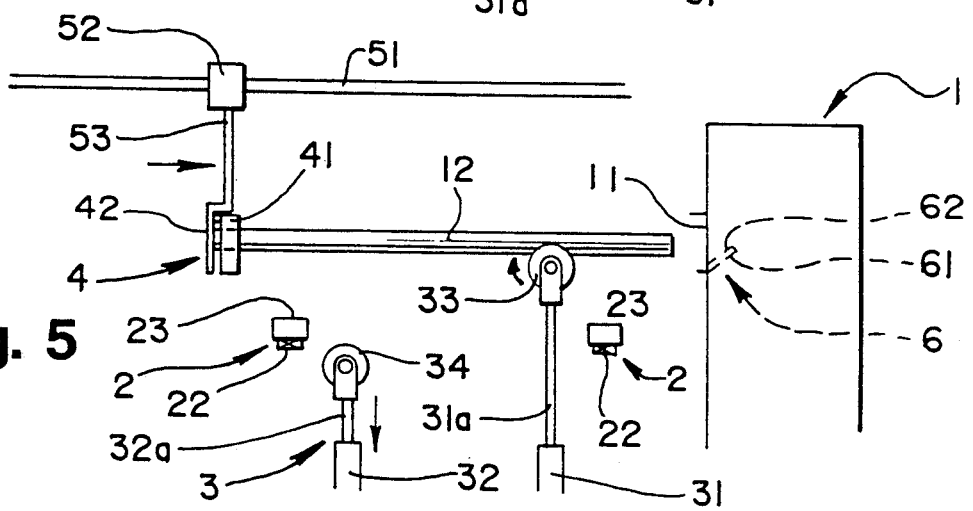
Fig. 5
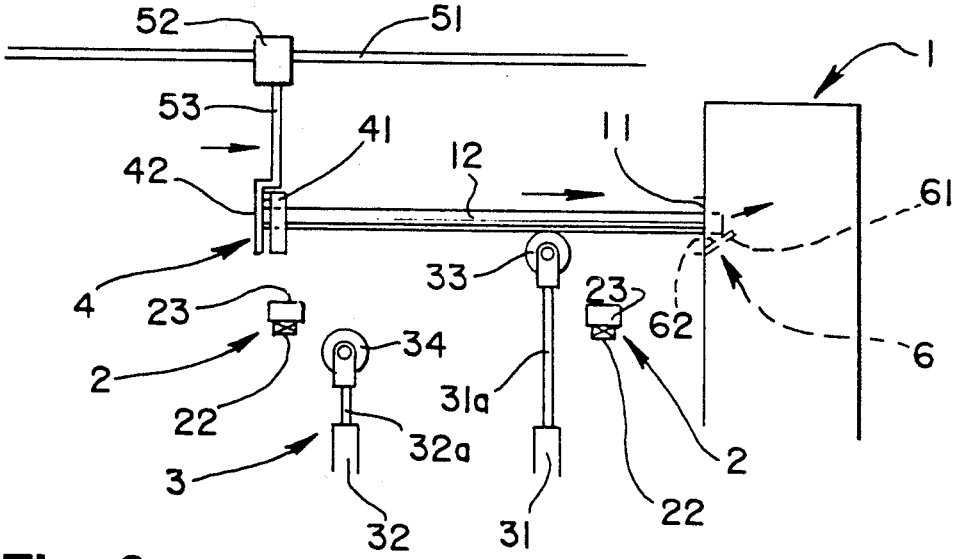
Fig. 6

Fig. 7
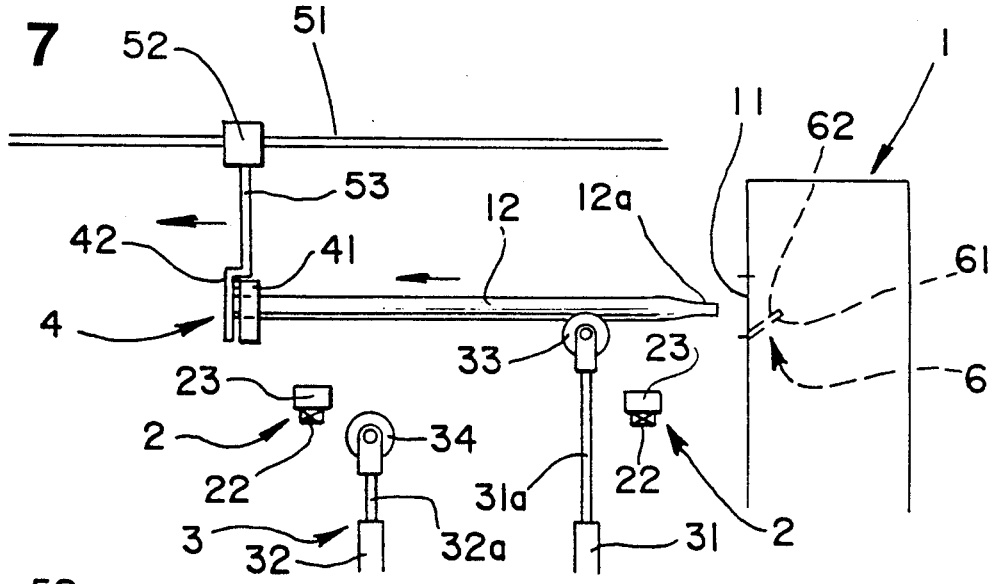
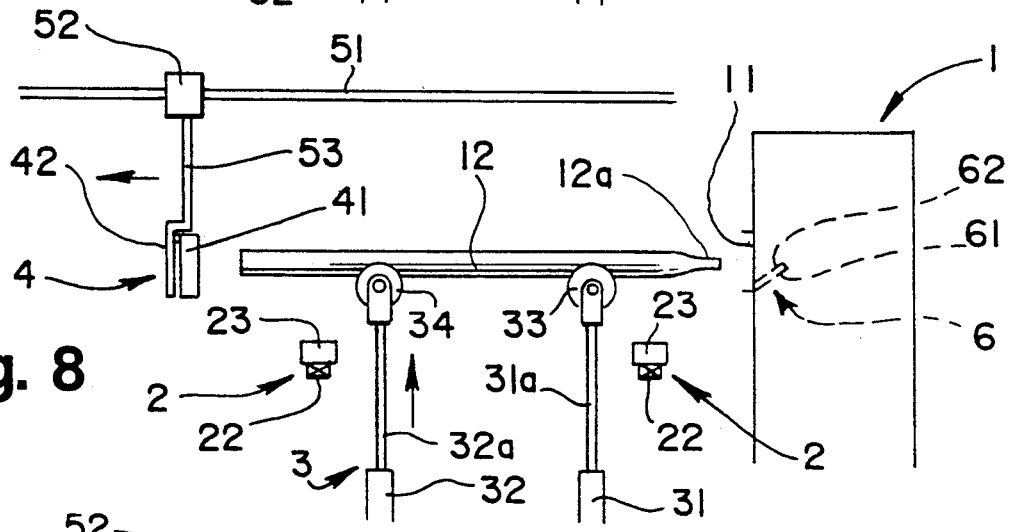
Fig. 8
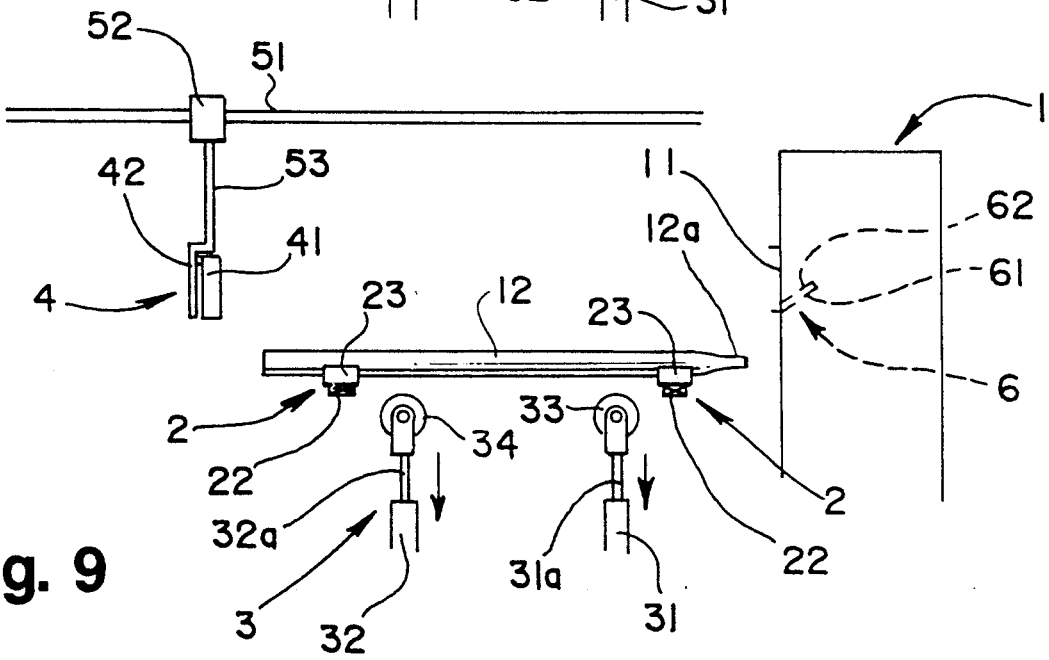
Fig. 9

APPARATUS FOR AUTOMATICALLY FORMING A POINTED END OF RAW PIPE TO BE DRAWN

BACKGROUND OF THE INVENTION

1. Field of the Invention

The invention relates to an apparatus for automatically forming a pointed end of a raw metal pipe such as aluminum pipe or the like which is subjected to drawing process, the pointed end being an extremity of said pipe and of such a reduced diameter as convenient for the drawing process.

2. Description of Prior Art

In the drawing process carried out for instance by the drawbench, an extremity of raw pipe is to be previously formed into a pointed end of reduced diameter so that the pointed end can be set through a drawing die and gripped by a chuck. The chuck is equipped in a drawing carriage disposed in front of the drawing die.

In general, a swaging machine is used to form such a pointed end. The drawing process has been employed also to manufacture base cylinders each supporting a photoconductive layer of such a photosensitive drum as incorporated in the electronic copiers, laser printers and the likes. The base cylinders must be of a high quality surface because they precisely support the photoconductive layers which are formed of selenium or organic photosensitive substances. According to a known operation in the process shown in FIG. 10, an operator 73 holds a middle or rear portion of a raw pipe 72 with special gloves on his hands. He inserts a front extremity of the pipe into a pipe inlet 74 of a swaging machine 71 so as to produce a pointed end at said extremity.

This manual operation for producing the pointed end however causes mental pressure and physical load to the operator, and such an operation is low in efficiency and productivity.

Further, the operator has to rely only on his keen scent to assure alignment of the pipe 72 with the swaging machine 71 during the operation. This has made it difficult for him to enhance an ideally linear shape to the pointed end, even with his excellent skillness. Directions in which said pointed ends deflect relative to the pipes are not constant, so that precision of the drawn pipes manufactured by means of the drawbench is affected. Yield of the products which can pass inspection is thus lowered.

Besides, there has been in the manual manufacture of the pointed ends a fear that peripheral surfaces of the raw pipes 72 would be scratched due to vibration of pipes during the swaging process, or be stained with small foreign particles even if a well skilled operator would work with his greatest carefulness and with the special gloves on his hands.

OBJECTS AND SUMMARY OF THE INVENTION

A primary object of the present invention which was made in view of the drawbacks in the abovementioned prior art is therefore to provide an apparatus which enables an operation for automatically forming a pointed end of a raw metal pipe to be drawn wherein with improved efficiency and productivity of the operation the pointed end is given a highly linear shape, thereby reducing variation in direction in which said pointed end deflects, and wherein no scratch is produced on the peripheral surface of the thus manufactured raw pipe to be drawn.

Other objects and advantages of the invention will become apparent from preferred embodiments thereof which will be described hereinafter referring to the drawings.

The primary object will be accomplished in the invention by providing an apparatus for automatically forming a pointed end at an end portion of each raw metal pipe which is subsequently subjected to a drawing process, the apparatus comprising:

a swaging machine which reduces a diameter of the end portion of the raw pipe to thereby deform the end portion into the pointed end;

a transporting device disposed below a height corresponding to a pipe inlet of the swaging machine and in front thereof, the transporting device carries thereon a plurality of the raw pipes which are arranged parallel with each other at regular intervals, and the transporting device being intermittently driven to sequentially transport the raw pipes which are in their positions parallel with a pipe inlet axis towards a horizontal area located therebelow;

a lifting device comprising a front supporter and a rear supporter which respectively support portions adjacent to a leading end or a trailing end of each raw pipe which has been transported to the horizontal area, the supporters then sequentially raising and lowering the raw pipes one after another between a height thereof on the transporting device and a further height of the pipe inlet; and a gripping device for gripping the trailing end of each raw pipe which has been raised to the further height by the lifting device, the gripping device reciprocating in a direction of the pipe inlet axis of the swaging machine so as to insert thereinto the leading end of each raw pipe, wherein the supporters of the lifting device are controlled not to be in contact with the pipe while the leading end is processed to form the pointed end.

The front supporter for supporting the portion near the leading end of each raw pipe is desirable to be an idle roller. It is also desirable that the rear supporter for supporting the portion near the trailing end of the pipe is lowered apart therefrom while said pipe is moved in the direction corresponding to the axis of raw pipes.

The pipe inlet is desirably provided with a guiding means which is adapted to guide the leading end of each raw pipe and to raise it a slight distance.

The machine, devices and means constituting the apparatus in the invention automatically cooperate with each other so that any manual operations as needed in the known apparatuses are no more required in producing the pointed ends of raw pipes.

The swaging process for producing said pointed ends can now be carried out while the trailing ends are kept in place by means of the gripping device, whereby highly straight pointed ends are formed without any significant quality variation among them.

In addition, vibration of the operating swaging machine will not cause any scratch on the peripheral surfaces of the raw pipe, since the supporters are kept away from said surfaces during operation of the swaging machine. The gripping device grips the trailing ends so that the raw pipes are made free from scratch and used without problem if only the trailing ends are cut after the pointed ends have been formed.

As described above, the front supporter is the idle roller supporting the forehand portion of each raw pipe, and the rear supporter supporting the rearward portion of each pipe is lowered to be out of contact with said pipe while it is moved in the axial direction thereof. Thus, each pipe is borne in a stable manner by the gripping device and the idle roller, thereby the peripheral surface of the pipe being protected from scratch which would otherwise be caused by its contact with the idler roller.

It is also to be noted that the guiding means functions in a manner such that each raw pipe comes out of contact with said idle roller simultaneously, without delay, when the leading end enters the pipe inlet of the swaging machine.

BRIEF DESCRIPTION OF THE DRAWINGS

FIG. 1 is a side elevation of an apparatus for automatically forming a pointed end in an embodiment of the invention;

FIG. 2 is a view seen from a line 2—2 in FIG. 1;

FIG. 3 is a view seen from a line 3—3 in FIG. 1;

FIG. 4 is a side elevation showing the apparatus at its state that raw pipes on a transporting device are lifted by a lifting device;

FIG. 5 is a side elevation showing a step at which one of the raw pipes is being pushed towards a swaging machine by means of a gripping device;

FIG. 6 is a side elevation showing a further step at which a leading end of the raw pipe has just been inserted in a pipe inlet of the swaging machine;

FIG. 7 is a further side elevation showing a still further step at which the raw pipe is pulling back away from said swaging machine, after the pointed end has been produced;

FIG. 8 is a still further side elevation showing a yet further step at which the gripping device is removed from the trailing end of the raw pipe;

FIG. 9 is a yet further side elevation showing a step at which the raw pipe is laid on the transporting device.

DETAILED DESCRIPTION OF PREFERRED

Figure 10:
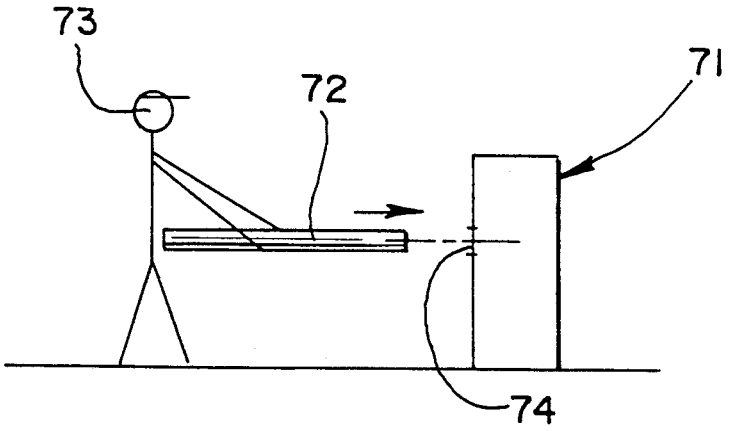
Fig. 10 PRIOR ART
FIG. 10 is a side elevation illustrating a known method for producing a pointed end.

Embodiments of the invention will now be described in detail referring to the drawings.

In an apparatus for automatically forming pointed ends, the reference numeral 1 denotes a swaging machine, the numeral 2 denotes a transporting device for transporting raw pipes, the numeral 3 denotes a lifting device for the raw pipes, the numeral 4 denotes a gripping device for said raw pipes, and the numeral 6 denotes a guiding means for guiding a leading end of each raw pipe.

Generally, the swaging machine 1 is a rotary swaging machine which is used to reduce a diameter of the leading end of the raw pipe 12 so as to form the pointed end 12*a*, the raw pipe being subsequently subjected later to a drawing process.

The transporting device 2 is a chain conveyor 2 comprising a pair of endless chains 22 and 22 which are disposed with a given distance therebetween and are driven to rotate intermittently and in unison with each other. Pairs of pipe rests 23 are disposed at regular intervals and attached to outer surfaces of the chains 22 at their positions corresponding to each other.

The chain conveyor 2 lies in parallel with a front face of the swaging machine 1 and extends from its left side to its right side, thus a pipe inlet 11 opens to the chain conveyor. Each of the raw pipes 12 is laid on the corresponding pipe rests 23 of the chains 22. The raw pipes 12 take their positions in parallel with an axis of the pipe inlet 11 of the swaging machine 1 and also in parallel with each other, so as to be transported one after another towards the pipe inlet from a side region in front of the machine.

An upper surface of the chain conveyor 2 is lower than the pipe inlet 11 of the swaging machine 1 so that each raw pipe 12 which has arrived at a location just opposite to the pipe inlet 11 is positioned below it.

The pipe rests 23 are made of a plastics or rubber which does not hurt or scratch peripheral surfaces of the raw pipes 12 when they are put onto, or while they are transported resting on, the pipe rests. As is shown in FIG. 2, bearing surfaces 23*a* of the pipe rests 23 are of a V-shape such that the raw pipes 12 are supported thereby in stable state without possibility of coming out of place, and at the same time contact surface is minimized between each pipe rest 23 and each raw pipe 12.

The lifting device 3 for raising and lowering the raw pipes comprises a pair of cylindrical actuators 31 and 32, and a pair of freely rotatable rollers 33 and 34 which are respectively journaled on the tops of piton rods 31*a* and 32*a* of said actuators.

Said cylindrical actuators 31 and 32 are located just opposite to the pipe inlet 11 of the swaging machine such that they are disposed below an intermediate part and respectively support forehand and rearward portions of said intermediate part of the raw pipe 12, which will be transported by the chain conveyor 2 to a region in front of said pipe inlet. The cylindrical actuators 31 and 32 operate in unison with each other so that the idle or freely rotatable rollers 33 and 34 are raised synchronously. Thus, the raw pipe 12 which has arrived in front of the pipe inlet 11 will be supported, at its peripheral surface of forehand and rearward portions, by means of said rollers so as to be raised to a height of the pipe inlet 11.

The cylindrical actuators 31 and 32 are controlled individually with the idle rollers 33 and 34 controlled to be raised or lowered synchronously or selectively.

The idle rollers are made of a plastics or rubber which does not hurt the raw pipe 12 when and while it is supported by said idle rollers. A pipe rest surface or recess 33*a* of the idle rollers are of a V-shape or inverted trapezoid as shown in FIG. 2. This shape makes it possible to support in a stable manner the raw pipe 12 and to reduce its surface in contact with the idle rollers so that the raw pipe 12 is prevented from rotating on its own axis and thus is protected from being scratched.

The gripping device 4 comprises a gripper 41 and a stopper 42. As shown in FIG. 3, the gripper 41 comprises a pair of arms 41*a* which are disposed right and left to face one another. The arms 41*a* of the gripper are pivoted at their upper ends so as to be rotated in opposite directions. Inner middle portions of the said arms 41*a* are formed as pipe rests 41*b* of such a shape that the raw pipe 12 is gripped between them at its peripheral surface. The pipe rests 41*b* of said arms 41*a* are made of a plastics or rubber and are V-shaped as shown in FIG. 3.

On the other hand, the stopper 42 is disposed adjacent to back surfaces of the gripper 41 in order to prevent it from moving towards the leading end of the raw pipe 12 while an outer surface at trailing end of said pipe is gripped by the gripper 41. The stopper 42 thus protects an intermediate portion of the raw pipe 12, by preventing the scratch on the outer surface from extending towards the leading end of said pipe 12.

The gripping device 4 comprising the gripper 41 and the stopper 42 is carried by a supporting arm 53 which extends from a traveling block 52. The traveling block 52 being guided by a guide rail 51 extending in a front-to-rear direction perpendicular to the front face of the swaging machine. The gripping device 4 thus can reciprocate in the front-to-rear direction at the height of the pipe inlet 11 of said swaging machine 1.

The aforementioned guiding means 6 for guiding the leading end of each raw pipe comprises a guide plate 61 which is disposed at a height corresponding to a lower portion of the pipe inlet 11. The guide plate 61 is inclined to ascend towards the inside of the swaging machine 1, thereby forming a slope. Therefore, the leading end of raw pipe 12 is inserted inwardly of the pipe inlet 11 so as to be raised a certain distance due to the slope 62 of said guide plate 61.

The apparatus which is constructed as above for forming the pointed end will operate as follows.

At first, the chain conveyor 2 is driven intermittently to transport a raw pipe 12 towards the pipe inlet 11 of the swaging machine 1.

Then, the front and the rear cylindrical actuators 31 and 32 are driven at the same time as shown in FIG. 4 so that their idle rollers 33 and 34 rise simultaneously to receive the raw pipe 12 from the upper surface of chain conveyor 2. Said idle rollers 33 and 34 thus raise the raw pipe 12 to the height of the pipe inlet 11 of swaging machine 1. The raw pipe 12 will not suffer any scratch even if it were displaced in its longitudinal direction while being raised in such a manner, because it is supported at its front and its rear portions on the idle or freely rotatable rollers 33 and 34.

Next, the traveling block 52 advances forward as shown in FIG. 5 from its rearward waiting position. The stopper 42 of the gripping device 4 comes into contact with the trailing end surface of the raw pipe 12, and at the same time the gripper 41 operates to grip the peripheral surface of said trailing end portion of said pipe. The raw pipe 12 is likely to be pushed a little when it engages with the stopper 42. However, the idle rollers 33 and 34 will not scratch the outer peripheral surface of said pipe 12.

Subsequently, only the rear cylindrical actuator 32 is operated to lower the rear idle roller 34. The raw pipe 12 is thus supported by the front idle roller 33 and by the gripper 41. The rear idle roller 34 which is retracted in this way so as not to hinder the gripping device 4 from moving forward will diminish contact surface which causes inadvertent scratch on the outer peripheral surface of the raw pipe 12.

The traveling block 52 is actuated again to advance forward, the gripping device 4 thereby moving the raw pipe 12 towards the pipe inlet 11 of the swaging machine 1. The idle roller 33 which rotates while the pipe is being moved forward will not cause any scratch on said peripheral surface.

As will be seen in FIG. 6, the leading end of the raw pipe 12 is then inserted in the inlet 11 and comes into contact with the guide plate 61 so that its slope 62 guides said end upwardly a slight distance. The gripper 42 functions as a fulcrum for such an upward motion of said leading end of raw pipe 12 wherein the front idle roller 34 becomes disjoined from the raw pipe. In other words, said raw pipe 12 at this stage is supported by the swaging machine 1 at its leading end and by the gripper 41 at its trailing end. This state is effective to protect said pipe 12 from any damages or scratches which the front idle roller 33 would otherwise cause due to vibration during the swaging process. It is also noted that the trailing end surface of the pipe 12 is borne by the stopper 42 during said swaging process so that any motion of the pipe 12 relative to the gripper 41 is inhibited to prevent any scratch from extending forward. A pointed end 12*a* which is of a diameter smaller than the pipe 12 itself will be formed in this manner at the leading end of said pipe by the swaging process.

Thereafter, the traveling block 52 moves back as shown in FIG. 7 so as to pull the leading end of the raw pipe 12 out of the pipe inlet 11 of the swaging machine 1, said pipe being supported by the front idle roller 33 and retracted to a given position. In detail, the leading end of the raw pipe 12 on the guide plate 61 gently slides down along the slope 62 thereof, until the intermediate portion of said pipe will rest on the front idle roller 33. Thus, there is also no danger of scratching the pipe during this step of operation. At a subsequent step shown in FIG. 8, the rear cylindrical actuator 32 operates to raise its idle roller 34. The raised idle roller 34 supports the pipe at its rearward portion, and subsequently the gripper 41 is released from the raw pipe 12. At a further step shown in FIG. 9, both the idle rollers 33 and 34 are synchronously lowered to return the raw pipe 12 onto the pipe rests 23 of the chain conveyor 2. After that, the chain conveyor 2 rotates a predetermined distance such that the next raw pipe 12 is transported to the horizontal region in alignment with the pipe inlet 11 so as to be processed to form the pointed end in the same manner as described above.

As will be apparent from the above description, the devices constituting the apparatus in the invention cooperate one another to automatically form the pointed ends for the raw pipes which are subjected later to the drawing process. Manual operations are dispensed with to improve the efficiency and productivity in producing the pointed ends. The swaging process for producing said pointed ends is carried out while the raw pipes are kept at the given position with their trailing ends gripped by the gripping device. Therefore, the pointed ends are ideally straight with no significant quality variation among them, this enhancing a higher accuracy and precision of the drawn pipes as well as a higher yield of products which can pass inspection. Both the supporters are kept away from each raw pipe while it is being swaged to form its pointed end so that said supporters cannot scratch the pipe even if the swaging machine would vibrate it, whereby the outer peripheral surface of each pipe is protected from any undesirable scratch during the process.

Furthermore, the portion adjacent to the leading end of each raw pipe is supported by the idle roller of the front supporter whereas the other portion adjacent to the trailing end is maintained apart from the rear supporter which is lowered while the pipe is moved longitudinally. That is, the pipe moving in its longitudinal direction is supported in a stable manner by the gripping device and on the front idle roller, thus the outer peripheral surface of said pipe being further made free from scratch caused by the idle rollers.

It is also to be noted that the guiding means functions such that the leading end of each raw pipe comes out of contact with said idle roller instantaneously when the leading end enters the pipe inlet of the swaging machine, whereby the efficiency of the process is further improved.

What is claimed is:

1. An apparatus for automatically forming a pointed end at an end portion of each raw pipe which is subsequently subjected to a drawing process, the apparatus comprising:

a swaging machine which reduces a diameter of the end portion of the raw pipe to thereby deform the end portion into the pointed end;

a transporting device disposed below a height corresponding to a pipe inlet of the swaging machine and in front thereof, the transporting device carrying thereon a plurality of the raw pipes which are arranged parallel with each other at regular intervals, and the transporting device being intermittently driven to sequentially transport the raw pipes which are in their positions parallel with a pipe inlet axis towards a horizontal area located therebelow;

a lifting device comprising a front supporter and a rear supporter which respectively support portions adjacent to a leading end or a trailing end of each raw pipe which has been transported to the horizontal area, the supporters then sequentially raising and lowering the raw pipes from the transporting device one after another between a height thereof on the transporting device and a further height of the pipe inlet; and a gripping device for gripping the trailing end of each raw pipe which has been raised to the further height by the lifting device, the gripping device reciprocating in a direction of the pipe inlet axis of the swaging machine so as to insert thereinto the leading end of each raw pipe, wherein the supporters of the lifting device are controlled not to be in contact with the pipe while the leading end is processed to form the pointed end, and wherein the front supporter includes an idle roller, and the rear supporter is kept away from the raw pipe while it is moving in its longitudinal direction.

2. An apparatus as defined in claim 1 wherein the pipe inlet is provided with a guiding means for guiding the leading end of each raw pipe so as to raise said leading end a slight distance.

3. An apparatus as defined in claim 2 wherein the guiding means comprises a guide plate which is disposed at a height corresponding to a lower portion of the pipe inlet and is inclined to ascend towards the inside of the swaging machine, thereby forming a slope.

4. An apparatus as defined in claim 1 wherein the gripping device comprises a pair of arms and a stopper disposed behind and adjacent to the arms so as to engage with a trailing end surface of the pipe, the arms being shaped to grip an outer peripheral surface of the raw pipe.

5. An apparatus as defined in claim 1 or 4 wherein the rear supporter comprises an idle roller.

* * * * *